US009004953B2

(12) United States Patent
Finona et al.

(10) Patent No.: US 9,004,953 B2
(45) Date of Patent: Apr. 14, 2015

(54) ELECTRICAL CONNECTOR

(71) Applicants: Michael S. Finona, Lake Forest, CA (US); Marc R. Gaddis, Los Angeles, CA (US)

(72) Inventors: Michael S. Finona, Lake Forest, CA (US); Marc R. Gaddis, Los Angeles, CA (US)

(73) Assignee: ITT Manufacturing Enterprises, LLC, Wilmington, DE (US)

( * ) Notice: Subject to any disclaimer, the term of this patent is extended or adjusted under 35 U.S.C. 154(b) by 284 days.

(21) Appl. No.: 13/628,716

(22) Filed: Sep. 27, 2012

(65) Prior Publication Data

US 2014/0087593 A1 Mar. 27, 2014

(51) Int. Cl.
*H01R 24/28* (2011.01)
*H01R 13/6473* (2011.01)

(52) U.S. Cl.
CPC ..... *H01R 13/6473* (2013.01)

(58) Field of Classification Search
USPC ..... 439/660.74, 682
See application file for complete search history.

(56) References Cited

U.S. PATENT DOCUMENTS

| | | | | |
|---|---|---|---|---|
| 4,066,316 | A | 1/1978 | Rollings | |
| 4,781,611 | A | 11/1988 | Leonard | |
| 4,900,278 | A | 2/1990 | Yamada et al. | |
| 5,169,324 | A | 12/1992 | Lemke | |
| 5,413,491 | A * | 5/1995 | Noschese | 439/108 |
| 5,632,634 | A | 5/1997 | Soes | |
| 5,860,814 | A | 1/1999 | Akama et al. | |
| 5,902,136 | A | 5/1999 | Lemke et al. | |
| 5,921,787 | A | 7/1999 | Pope et al. | |
| 6,152,742 | A | 11/2000 | Cohen et al. | |
| 6,454,610 | B1 * | 9/2002 | Yu | 439/660 |
| 7,744,416 | B2 | 6/2010 | Zhang et al. | |
| 7,901,218 | B2 * | 3/2011 | Sato et al. | 439/74 |
| 2006/0246780 | A1 | 11/2006 | Bert et al. | |
| 2009/0170381 | A1 | 7/2009 | Sommovigo et al. | |

OTHER PUBLICATIONS

European Search Report, dated Feb. 4, 2015, corresponding to counterpart European Patent Application No. 13184919.2.

* cited by examiner

*Primary Examiner* — Briggitte R Hammond
(74) *Attorney, Agent, or Firm* — RatnerPrestia

(57) ABSTRACT

Electrical connectors are disclosed. One electrical connector comprises a receptacle component and a plug component. The receptacle component includes a receptacle body portion having a pair of opposed walls defining a gap therebetween. The pair of opposed walls each having one or more openings in their respective ends. The receptacle component also includes a plurality of first metal contacts partially surrounded by the pair of opposed walls. The plug component includes a plug body portion having a projection. The projection is sized to fit within the gap between the pair of opposed walls of the receptacle component. The plug component also includes a plurality of second metal contacts extending from the plug body portion. Ends of the second metal contacts are positioned to extend into the openings in the pair of opposed walls when the projection is positioned within the gap between the pair of opposed walls.

9 Claims, 4 Drawing Sheets

ELECTRICAL CONNECTOR

FIELD OF THE INVENTION

The present invention relates generally to electrical connectors, and more particularly to electrical connectors for low-voltage differential signaling (LVDS).

BACKGROUND OF THE INVENTION

Conventionally, many methods exist for transmitting data electronically from one location to another. When data is transmitted over wires, electrical connectors are required for enabling data transmission between transmission lines and/or electrical circuits. Most conventional electrical connectors include a male or plug component designed to mate with a female or receptacle component.

One particular method for transmitting data is differential signaling. In differential signaling, data is transmitted using a difference in voltage between signals transmitted on two or more lines. In differential signaling systems, the transmission of data is affected by the characteristic impedance of the transmission lines and any electrical connectors coupled to those transmission lines. Accordingly, characteristic impedance is an important consideration for any electrical connector used in differential signaling.

SUMMARY OF THE INVENTION

Aspects of the present invention are directed to electrical connectors.

In accordance with one aspect of the present invention, an electrical connector is disclosed. The electrical connector comprises a receptacle component and a plug component. The receptacle component includes a receptacle body portion having a receptacle base and a pair of opposed walls extending from the receptacle base in a first direction. The pair of opposed walls define a gap therebetween. The pair of opposed walls each having one or more openings facing the first direction formed in their respective ends. The receptacle component also includes a plurality of first metal contacts coupled to the receptacle body portion. The first metal contacts each have first ends surrounded by the pair of opposed walls and second ends extending from the receptacle base in a direction opposite the first direction. The plug component includes a plug body portion having a plug base and a projection extending from the plug base in a second direction. The projection is sized to fit within the gap between the pair of opposed walls of the receptacle component. The plug component also includes a plurality of second metal contacts coupled to the plug body portion. The second metal contacts each have first ends extending from the plug base in the second direction and second ends extending from the plug base in a direction opposite the second direction. The first ends of the second metal contacts are positioned to extend into the openings in the pair of opposed walls when the projection is positioned within the gap between the pair of opposed walls.

In accordance with another aspect of the present invention, a receptacle component for an electrical connector is disclosed. The receptacle component includes a receptacle body portion and a plurality of metal contacts coupled to the receptacle body portion. The receptacle body portion has a receptacle base and a pair of opposed walls extending from the receptacle base in a first direction. The pair of opposed walls define a gap therebetween. The pair of opposed walls each have one or more openings facing the first direction formed in their respective ends. The metal contacts each have first ends surrounded by the pair of opposed walls and second ends extending from the receptacle base in a direction opposite the first direction.

In accordance with yet another aspect of the present invention, a plug component for an electrical connector is disclosed. The plug component includes a plug body portion and a plurality of metal contacts coupled to the plug body portion. The plug body portion has a plug base and a projection extending from the plug base in a first direction. The projection is sized to fit within a gap between a pair of opposed walls of a receptacle component. The metal contacts each have first ends extending from the plug base in the first direction and second ends extending from the plug base in a direction opposite the first direction.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. According to common practice, the various features of the drawings are not drawn to scale, unless otherwise indicated. To the contrary, the dimensions of the various features may be expanded or reduced for clarity. Included in the drawings are the following figures.

DETAILED DESCRIPTION OF THE INVENTION

Embodiments of the present invention are directed to improvements in electrical connectors. These exemplary embodiments are particularly suitable for use as electrical connectors in low-voltage differential signaling (LVDS) systems. Nonetheless, while LVDS applications are address primarily herein, the present invention may be used in a wide variety of electrical systems, as would be understood by one of ordinary skill in the art from the description herein. Thus, nothing herein is intended to limit the scope of use of the disclosed embodiments.

The disclosed electrical connectors are designed such that their characteristic impedance may be precisely selected. As will be discussed below in greater detail, the characteristic impedance of the electrical connectors may be preselected based on the dimensions and materials with which they are formed. By precisely selecting their characteristic impedance, the disclosed electrical connectors may be particularly advantageous for use in all applications in which impedance matching is desired, such as, for example, differential signaling.

As a general overview, the disclosed embodiments of the present invention include a plug component and a receptacle component. The plug component includes at least one signal contact and at least one ground contact, and a projection separating them. The projection may be wedge-shaped. The receptacle component includes openings for mating with the ground and signal contact(s) of the plug component, and a gap for receiving the projection of the plug component. When the components are mated, the bodies of the respective plug and receptacle components, including the projection, may fill a space between the at least one signal contact and the at least one ground contact. By filling this space, the electrical connector creates a fixed distance between the signal and ground contacts, and controls the material between the signal and ground contacts, thereby controlling the characteristic impedance of the connector.

Figure 1B:
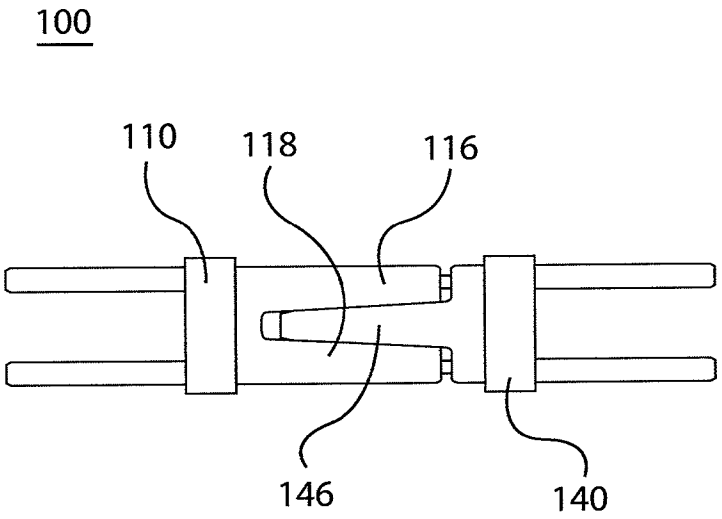
FIGS. 1A and 1B are images illustrating an exemplary electrical connector in accordance with aspects of the present invention.
Figure 1A:
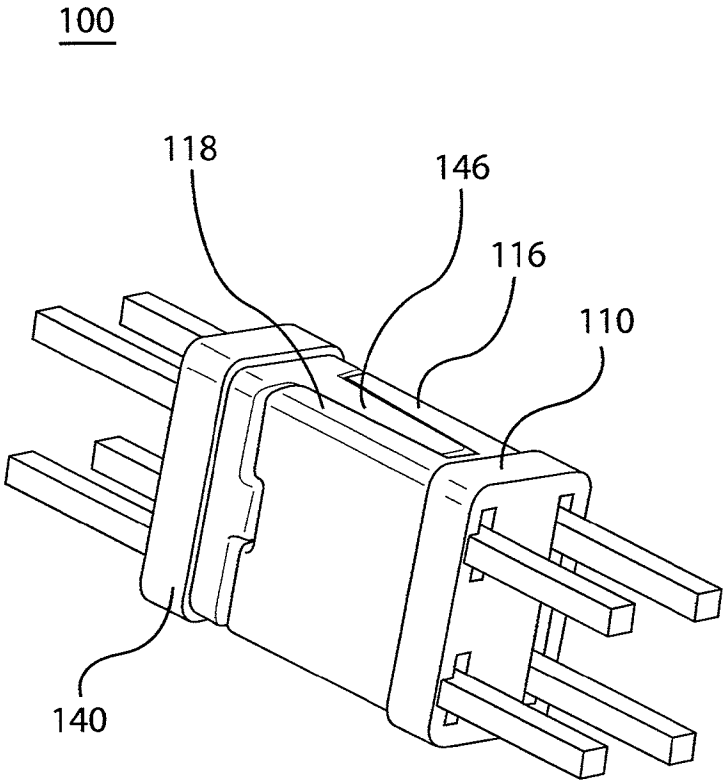

Referring now to the drawings, FIGS. 1A and 1B illustrate an exemplary electrical connector 100 in accordance with aspects of the present invention. Electrical connector 100 may be particularly suitable for low-voltage differential signaling applications. Generally, connector 100 includes a receptacle component 110 and a plug component 140. Additional details of connector 100 will be described herein.

Figure 2B:
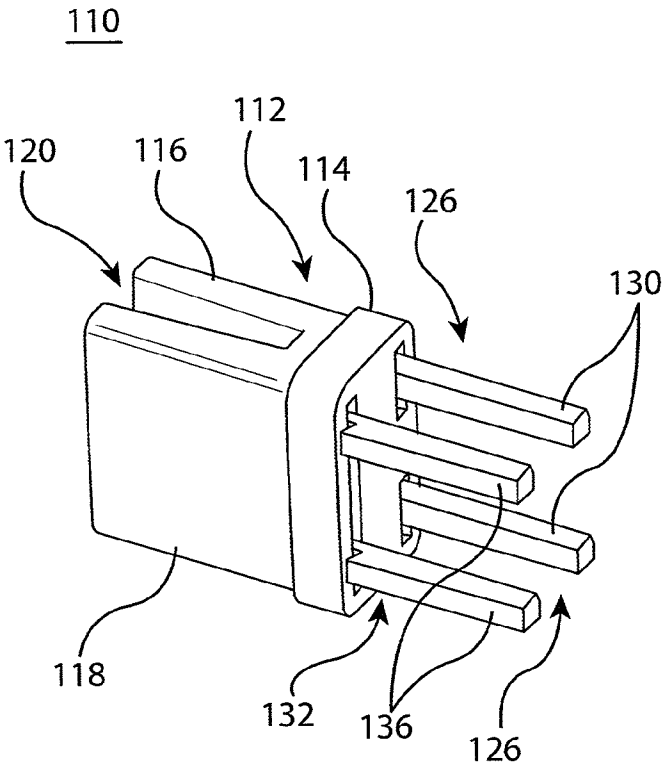
FIGS. 2A and 2B are images illustrating an exemplary receptacle component of the electrical connector of FIGS. 1A and 1B.
Figure 2A:
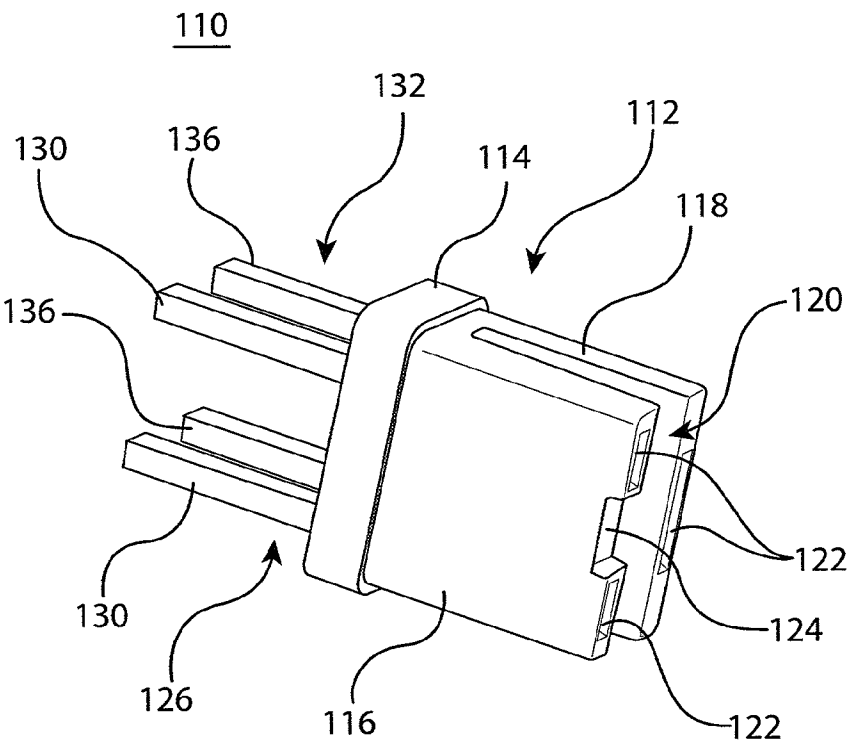

Receptacle component 110 includes a receptacle body 112 and a plurality of metal contacts 126 and 132. As shown in FIGS. 2A and 2B, receptacle body 112 has a receptacle base 114 and a pair of opposed walls 116 and 118 extending outward from receptacle base 114 in a given direction. A gap 120 is defined between the pair of opposed walls 116 and 118. In an exemplary embodiment, receptacle body 112 is formed from a polymer material such as, for example, polyphenylene sulfide. As shown in FIG. 2A, walls 116 and 118 each have openings 122 facing in the given direction formed in their respective ends. As will be discussed below, openings 122 enable mating contacts from plug component 140 to be received within receptacle body 112 when connector 100 is assembled.

Metal contacts 126 and 132 are coupled to receptacle body 112. Metal contacts 126 each have a first end 128 contained within receptacle body 112. First ends 128 of metal contacts 126 are surrounded by wall 116. Metal contacts 126 each also have a second end 130 that extends from receptacle base 114 in a direction opposite the given direction. Like metal contacts 126, metal contact 132 has a first end 134 contained within receptacle body 112. First end 134 of metal contact 132 is surrounded by wall 118. Metal contact 132 also has a pair of second ends 136 that extend from receptacle base 114 in a direction opposite the given direction.

As shown in FIGS. 1B, 2A, and 2B, each second end 136 of metal contact 132 is aligned with a respective second end 130 of a metal contact 126, when viewed in a direction perpendicular to the give direction (i.e., when viewed from the side of receptacle component 110). In other words, second ends 136 have an overlapping profile with second ends 130 in receptacle component 110. This may be desirable in order to minimize the possibility of ground loops created by connector 100.

The distance between second ends 136 of metal contact 132 is equal to the distance between second ends 130 of metal contacts 126. Additionally or alternatively, the distance between each second end 136 of metal contact 132 and the respective (aligned) second end 130 of metal contact 126 is equal. Thus, in an exemplary embodiment, the second ends 136 of metal contact 132 and the second ends 130 of metal contacts 126 may define a rectangular shape when viewed from an end of receptacle component 110, as shown in FIGS. 2A and 2B. Additionally, as shown in FIGS. 1B, 2A, and 2B, the second ends 136 of metal contact 132 extend from receptacle body 112 the same distance as second ends 130 of metal contacts 126.

Figure 3B:
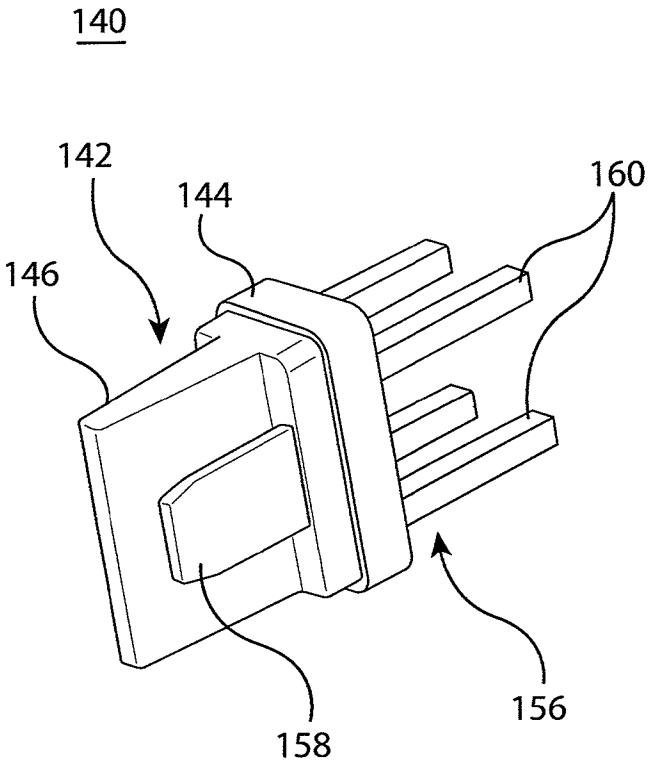
FIGS. 3A and 3B are images illustrating an exemplary plug component of the electrical connector of FIGS. 1A and 1B.
Figure 3A:
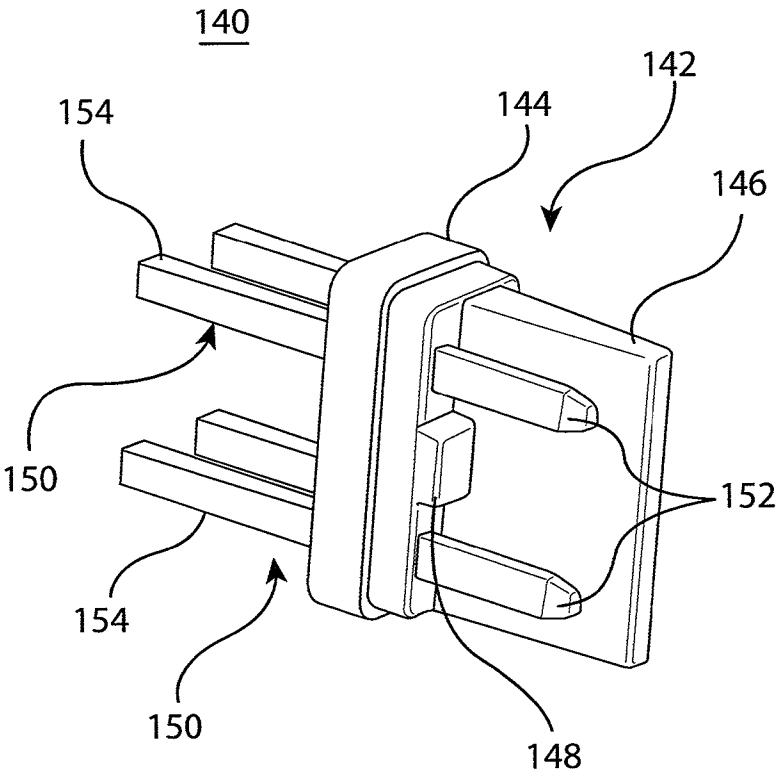

Plug component 140 includes a plug body 142 and a plurality of metal contacts 150 and 156. As shown in FIGS. 3A and 3B, plug body 142 has a plug base 144 and a projection 146 extending outward from the plug base 144 in a given direction. Projection 146 is sized to fit within gap 120 between walls 116 and 118 of receptacle component 110. In an exemplary embodiment, plug body 142 is formed from a polymer material such as, for example, polyphenylene sulfide.

Metal contacts 150 and 156 are coupled to plug body 142. Metal contacts 150 each have a first end 152 extending outward from plug base 144 in the given direction. Metal contacts 150 each also have a second end 154 that extends from plug base 144 in a direction opposite the given direction. Like metal contacts 150, metal contact 156 has a first end 158 extending outward from plug base 144 in the given direction. Metal contact 156 also has a pair of second ends 160 that extend from plug base 144 in a direction opposite the given direction.

Second ends 160 of metal contact 156 and second ends 154 of metal contacts 150 have substantially the same arrangement as second ends 136 and 130 of receptacle component 110. In particular, as shown in FIGS. 1B, 3A, and 3B, each second end 160 of metal contact 156 is aligned with a respective second end 154 of a metal contact 150, when viewed in a direction perpendicular to the give direction (i.e., when viewed from the side of plug component 140). Additionally, in an exemplary embodiment, the second ends 160 of metal contact 156 and the second ends 154 of metal contacts 150 may define a rectangular shape when viewed from an end of plug component 140, as shown in FIGS. 3A and 3B. As shown in FIGS. 1B, 3A, and 3B, the second ends 160 of metal contact 156 extend from plug body 142 the same distance as second ends 154 of metal contacts 150.

Plug component 140 is mated with receptacle component 110 by inserting projection 146 within the gap 120 between walls 116 and 118. The first ends 152 and 158 of metal contacts 150 and 156 are positioned such that they extend into openings 122 provided in the pair of opposed walls 116 and 118 when plug component 140 is mated with receptacle component 110. As shown in FIGS. 3A and 3B, first ends 152 and 158 of metal contacts 150 and 156 do not directly contact projection 146. This may be desirable in order to facilitate insertion of metal contacts 150 and 156 within the openings 122 of walls 116 and 118. In the mated position, first ends 152 and 158 of metal contacts 150 and 156 make contact with first ends 128 and 134 of metal contacts 126 and 132, respectively, in order to establish an electrical connection within electrical connector 100.

As shown in FIGS. 1A and 1B, gap 120 desirably has an inverse wedge shape, and projection 146 desirably has a matching wedge shape. Forming projection 146 in a wedge shape may be desirable in order to assist in alignment of plug component 140 with receptacle component 110 during mating. The wedge shape of projection 146 desirably guides plug component 140 into a predetermined position with respect to receptacle component 110. However, it will be understood by one of ordinary skill in the art that the wedge shapes shown in the figures are for the purposes of illustration, and that gap 120 and projection 146 may have any matching shapes that enable a sliding insertion of projection 146 within gap 120.

As shown in FIGS. 1A and 1B, when projection 146 is positioned within gap 120, no open space exists between the sides of projection 146 and the sides of walls 116 and 118.

This feature may be desirable in order to provide the same material (and thus a constant dielectric constant) between metal contacts 150 and 156 (and between metal contacts 126 and 132). A constant dielectric constant between the contacts may be useful in order to precisely determine the characteristic impedance of the connector 100.

As shown in FIGS. 3A and 3B, projection 146 has a length greater than the length of first ends 152 and 158 of metal contacts 150 and 156. The length of projection 146 may be such that when projection 146 is positioned within gap 120, projection 146 extends all the way to receptacle base 114, i.e., projection 146 completely fills gap 120 between walls 116 and 118.

Figure 4B:
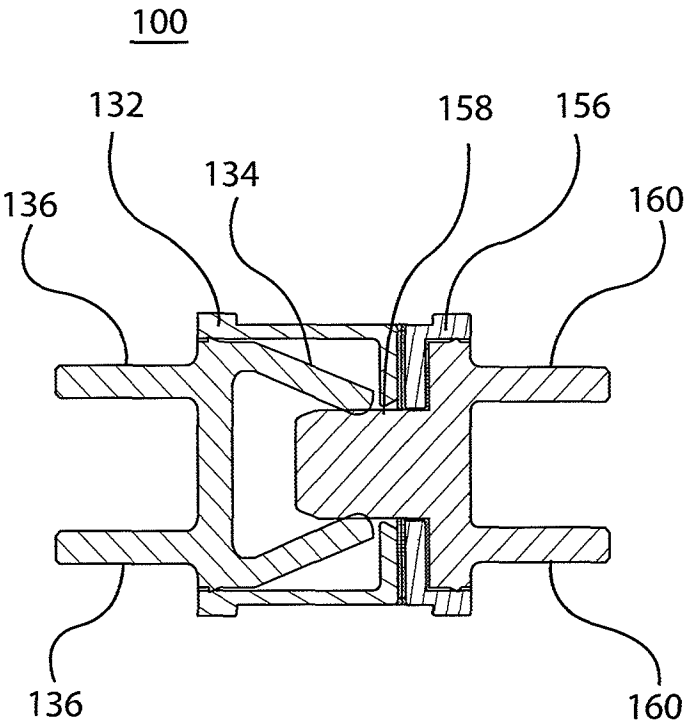
FIGS. 4A and 4B are cross-sectional views of the exemplary electrical connector of FIGS. 1A and 1B.
Figure 4A:
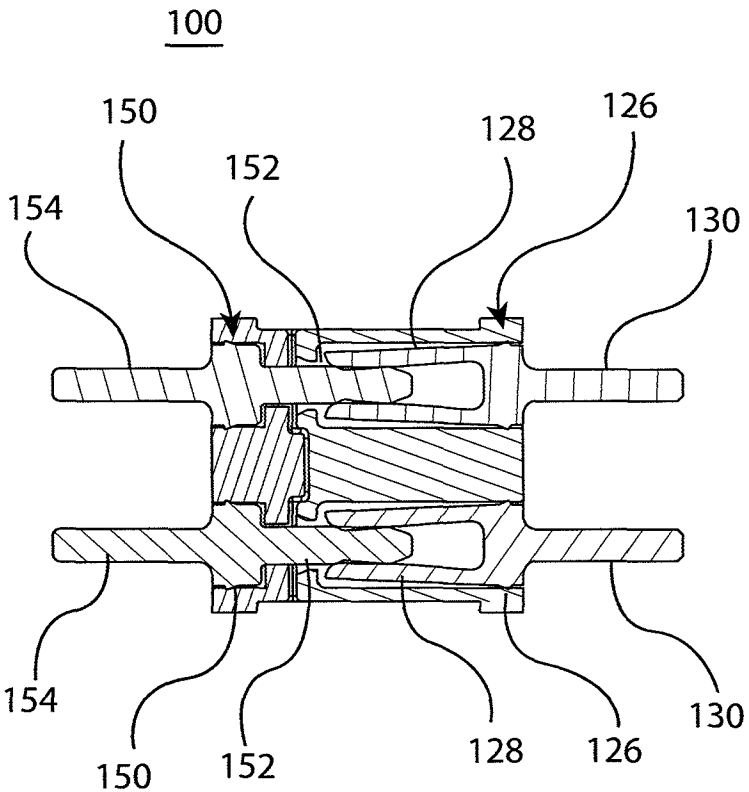

FIGS. 4A and 4B shown a cross-sectional view of a mating arrangement of contacts 126 and 132 with contacts 150 and 156. As shown in FIGS. 4A and 4B, first ends 128 of metal contacts 126 and first end 134 of metal contact 132 are configured to contact first ends 152 of metal contacts 150 and first end 158 of metal contact 156, respectively. In an exemplary embodiment, first ends 128 and 134 comprise a pair of prongs adapted to receive first ends 152 and 158 therebetween, as shown in FIGS. 4A and 4B. The prongs of first ends 128 and 134 press against the sides of first ends 152 and 158. As shown in FIG. 4B, in this embodiment, first end 158 of contact 156 consists of a tab-shaped projection that has a width exceeding its thickness. Openings 122 in receptacle body 112 are sized to closely fit first ends 152 and 158 when plug component 140 is mated with receptacle component 110.

Connector 100 is described herein as having two contacts 126 and 150, and a single contact 132 and 156. In an exemplary embodiment, contacts 126 and 150 are signal contacts, and are coupled to receive and transmit a differential signal within an LVDS system. In this embodiment, contacts 132 and 156 are ground contacts, and are coupled to a ground potential within the LVDS system. While connector 100 is shown as including two signal contacts, it will be understood by one of ordinary skill in the art that the invention is not so limited. Connector 100 may include any number of contacts to transfer electrical signals/potential, as is determined to be necessary for the application in which connector 100 is used.

The above-described electrical connector 100 is particularly suitable for impedance matching applications, because the characteristic impedance of connector 100 in the mated position may be precisely determined. The characteristic impedance of connector 100 may be preselected based on the dimensions and materials of connector 100. An example is provided herein for the purposes of illustration.

For certain applications, e.g. LVDS, it may be desirable that connector 100 have a characteristic impedance of 100Ω. To create a characteristic impedance of 100Ω, the distance between signal contacts 126 and 150 and ground contacts 132 and 156 may be chosen to be approximately 75 mils when receptacle component 110 and plug component 140 are mated. This distance may be predetermined by choosing appropriate thicknesses for walls 116 and 118 and projection 146. In addition, receptacle body 112 and plug body 142 may be chosen to have a diameter of 31.5 mils. Suitable materials for forming receptacle body 112 and plug body 142 have a dielectric constant of 3.5, for example. By manufacturing a connector 100 having the above-described dimensions and materials, connector 100 can be preselected to have a characteristic impedance of 100Ω. Connectors 100 having different characteristic impedance may be created by altering the above factors, as would be understood by one of ordinary skill in the art from the description herein.

Connector 100 is not limited to the above components, but may include alternative or additional components, as would be understood by one of ordinary skill in the art from the description herein.

Connector 100 may include keying features to ensure a correct alignment between receptacle component 110 and plug component 140 when they are mated. In an exemplary embodiment, receptacle component 110 includes a notch 124 formed on the end of one of the pair of opposing walls 116 and 118. Likewise, plug component 140 includes a protrusion 148 in a position to mate with notch 124 of receptacle component 110 when receptacle component 110 and plug component 140 are mated. The mating of protrusion 148 with notch 124 desirably ensures a correct alignment between receptacle component 110 and plug component 140, as would be understood by one of ordinary skill in the art.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. An electrical connector comprising:

a receptacle component including:

a receptacle body portion having a receptacle base and a pair of opposed walls extending from the receptacle base in a first direction, the pair of opposed walls defining a gap therebetween, the pair of opposed walls each having one or more openings facing the first direction formed in their respective ends; and a plurality of first metal contacts coupled to the receptacle body portion, the first metal contacts each having first ends surrounded by the pair of opposed walls and second ends extending from the receptacle base in a direction opposite the first direction; and a plug component including:

a plug body portion having a plug base and a projection extending from the plug base in a second direction, the projection sized to fit within the gap between the pair of opposed walls of the receptacle component; and a plurality of second metal contacts coupled to the plug body portion, the second metal contacts each having first ends extending from the plug base in the second direction and second ends extending from the plug base in a direction opposite the second direction, the first ends of the second metal contacts positioned to extend into the openings in the pair of opposed walls when the projection is positioned within the gap between the pair of opposed walls.

2. The electrical connector of claim 1, wherein when the projection is positioned within the gap between the pair of opposed walls, no open space exists between sides of the projection and sides of the opposed walls.

3. The electrical connector of claim 1, wherein the projection has a length greater than the length of each first end of the second metal contacts.

4. The electrical connector of claim 3, wherein when the projection is positioned within the gap between the pair of opposed walls, the projection extends to the receptacle base.

5. The electrical connector of claim 1, wherein the gap between the pair of opposed walls has an inverse wedge shape; and the projection has a wedge shape matching the inverse wedge shape of the gap.

6. The electrical connector of claim 1, wherein the first ends of the second metal contacts do not directly contact the projection.

7. The electrical connector of claim 1, wherein one of the pair of opposed walls includes a notch in its end, and the plug body includes a protrusion positioned to mate with the notch.

8. The electrical connector of claim 1, wherein the receptacle body portion and the plug body portion are formed from a polymer material.

9. The electrical connector of claim 8, wherein the polymer material comprises polyphenylene sulfide.

* * * * *